US010492625B1

(12) United States Patent
De Sanctis et al.

(10) Patent No.: US 10,492,625 B1
(45) Date of Patent: Dec. 3, 2019

(54) BEVERAGE CONTAINER SERVING APPARATUS INCLUDING MOVABLE GATE AND RELATED METHODS

(71) Applicant: ONA Creative, LLC, Orlando, FL (US)

(72) Inventors: Adrian De Sanctis, Orlando, FL (US); Ofer Fridfertig, Windermere, FL (US)

(73) Assignee: ONA Creative, LLC., Orlando, FL (US)

( * ) Notice: Subject to any disclaimer, the term of this patent is extended or adjusted under 35 U.S.C. 154(b) by 0 days.

(21) Appl. No.: 16/009,903

(22) Filed: Jun. 15, 2018

(51) Int. Cl.
*A47F 1/04* (2006.01)

(52) U.S. Cl.
CPC ..... *A47F 1/04* (2013.01)

(58) Field of Classification Search
None
See application file for complete search history.

(56) References Cited

U.S. PATENT DOCUMENTS 2,029,263 A * 1/1936 Keighley ..... F25D 11/02 211/74
2,678,735 A * 5/1954 Crcedon ..... F25D 25/00 211/151
3,501,016 A * 3/1970 Eaton ..... A47F 7/28 211/49.1
5,209,358 A * 5/1993 Simard ..... A47F 3/002 211/74
5,865,324 A * 2/1999 Jay ..... A47F 1/12 211/59.2
6,065,587 A * 5/2000 Schindel ..... B65G 47/1457 198/392
6,502,408 B1 * 1/2003 Corcoran ..... F25D 25/00 193/35 R
6,637,604 B1 * 10/2003 Jay ..... A47F 1/12 211/59.2
7,604,145 B2 * 10/2009 Percy ..... G07F 11/42 221/126

(Continued)

FOREIGN PATENT DOCUMENTS

GB 2247673 A 11/1992
JP 2015112441 A 6/2015

OTHER PUBLICATIONS

JGS Enterprise, LLC; U-Bottle; Product Brochure; retrieved from the internet on Jun. 15, 2018; web address: http://u-bottle.com/ubottle.html; 1 page.

*Primary Examiner* — Jacob S. Scott
*Assistant Examiner* — Ayodeji T Ojofeitimi
(74) *Attorney, Agent, or Firm* — Allen, Dyer, Doppelt + Gilchrist, P.A.

(57) ABSTRACT

A beverage container serving apparatus for beverage containers may include a floor and at least one sidewall extending upwardly from the floor and including a curved base segment and a pair of parallel arms extending from the curved base segment. The beverage container serving apparatus may further include an inner wall extending upwardly from the floor between the pair of parallel arms defining a container channel having a container inlet into which beverage containers are input and a container outlet from which the beverage containers are served. A movable gate may be adjacent one of the container inlet and container outlet and configured to maintain a given beverage container within the container channel.

22 Claims, 14 Drawing Sheets

(56) References Cited

U.S. PATENT DOCUMENTS

| | | | | |
|---|---|---|---|---|
| 7,823,733 | B2 * | 11/2010 | Futori | A47F 1/087 211/49.1 |
| 7,997,427 | B2 * | 8/2011 | Lowenbraun | A47F 1/12 211/59.2 |
| 8,087,541 | B2 * | 1/2012 | Valota | G07F 11/58 221/175 |
| 8,789,724 | B2 * | 7/2014 | Roncari | G07F 11/42 221/251 |
| 10,045,637 | B2 * | 8/2018 | Akins | A47F 1/125 |
| 2009/0254214 | A1 * | 10/2009 | Kudera | G07F 11/54 700/231 |
| 2011/0226794 | A1 * | 9/2011 | Carpentier | G07F 11/24 221/1 |
| 2013/0015196 | A1 * | 1/2013 | Subu | A47F 1/12 221/1 |
| 2013/0037562 | A1 * | 2/2013 | Close | A47F 1/126 221/279 |
| 2015/0001244 | A1 * | 1/2015 | Bauer | A47F 1/04 221/197 |
| 2015/0063956 | A1 * | 3/2015 | King | G07F 11/24 414/226.05 |
| 2015/0102052 | A1 * | 4/2015 | Kim | B65D 83/00 221/151 |

* cited by examiner

BEVERAGE CONTAINER SERVING APPARATUS INCLUDING MOVABLE GATE AND RELATED METHODS

TECHNICAL FIELD

The present embodiments are directed to the field of beverage containers, and more particularly, to beverage container serving, and related methods.

BACKGROUND

Beverage containers are typically loaded into a refrigeration unit, for example, by placing the container farthest back from the door on a wire shelf. In particular, in a restaurant or bar environment, the beverage containers, which may be in the form of glass bottles, are typically loaded into the refrigeration unit early in a day and reloaded when supply or the amount of beverage containers or bottles on the shelf becomes relatively low. In a busy restaurant or bar, loading or reloading may occur multiple times in a relatively short amount of time, for example, hourly. It is not typical to permit all the beverage containers on a given shelf within the refrigeration unit to be used or pulled prior to reloading.

Many beverages that are loaded into the refrigeration unit, particularly in a restaurant or bar, have a best-by date, freshness date, or use-by date associated with it. This date is typically printed on the beverage container or bottle itself and/or a label on the beverage container. Upon reloading of a refrigeration unit with beverage containers, the dates printed on the beverage containers are not typically visually checked and those beverage containers with a more current date are thus not rotated or brought to the front of the shelf in the refrigeration unit. This may be particularly true in a busy restaurant or bar environment. Instead, newer beverage containers having a date that is farther away are placed in the front of the older beverage containers. Thus, the older beverage containers may not be used by their associated best-by date, freshness date, or use-by date.

SUMMARY

A beverage container serving apparatus for a plurality of beverage containers may include a floor and at least one sidewall extending upwardly from the floor and that includes a curved base segment and a pair of parallel arms extending from the curved base segment. The beverage container serving apparatus may also include an inner wall extending upwardly from the floor between the pair of parallel arms defining a container channel having a container inlet into which the plurality of beverage containers is input and a container outlet from which the plurality of beverage containers is served. A movable gate may be adjacent one of the container inlet and container outlet and configured to maintain a given beverage container from among the plurality thereof within the container channel.

The at least one sidewall may have a U-shape, for example. The movable gate may include a hinge coupled to the inner wall and a movable arm coupled to the hinge so that the arm is movable between the container inlet and the container outlet.

The movable gate may include a ratcheting turnstile. The movable gate may include a curved gate integrally molded with at least one of the inner wall and the at least one sidewall, for example.

The movable gate may include at least one resilient protrusion extending into the container channel. The at least one resilient protrusion may have a curved shape, for example. The at least one resilient protrusion may include a plurality of spaced apart resilient protrusions extending along the at least one sidewall and the inner wall, for example.

The floor may be sloped downwardly relative to the container inlet and container outlet. The beverage container serving apparatus may also include at least one further inner wall extending upwardly from the floor to define a plurality of container channels, for example. The beverage container serving apparatus may also include at least one further movable gate adjacent the curved base segment to selectively block at least one corresponding container channel from the plurality thereof, for example.

A method aspect is directed to a method of making a beverage container serving apparatus for a plurality of beverage containers. The method may include forming a floor and forming at least one sidewall extending upwardly from the floor and that includes a curved base segment and a pair of parallel arms extending from the curved base segment. The method may also include forming an inner wall extending upwardly from the floor between the pair of parallel arms defining a container channel having a container inlet into which the plurality of beverage containers is input and a container outlet from which the plurality of beverage containers is served. The method may further include forming a movable gate adjacent one of the container inlet and container outlet and configured to maintain a given beverage container from among the plurality thereof within the container channel.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation and increments of 100 are used to indicate similar elements in alternative embodiments.

Figure 1:
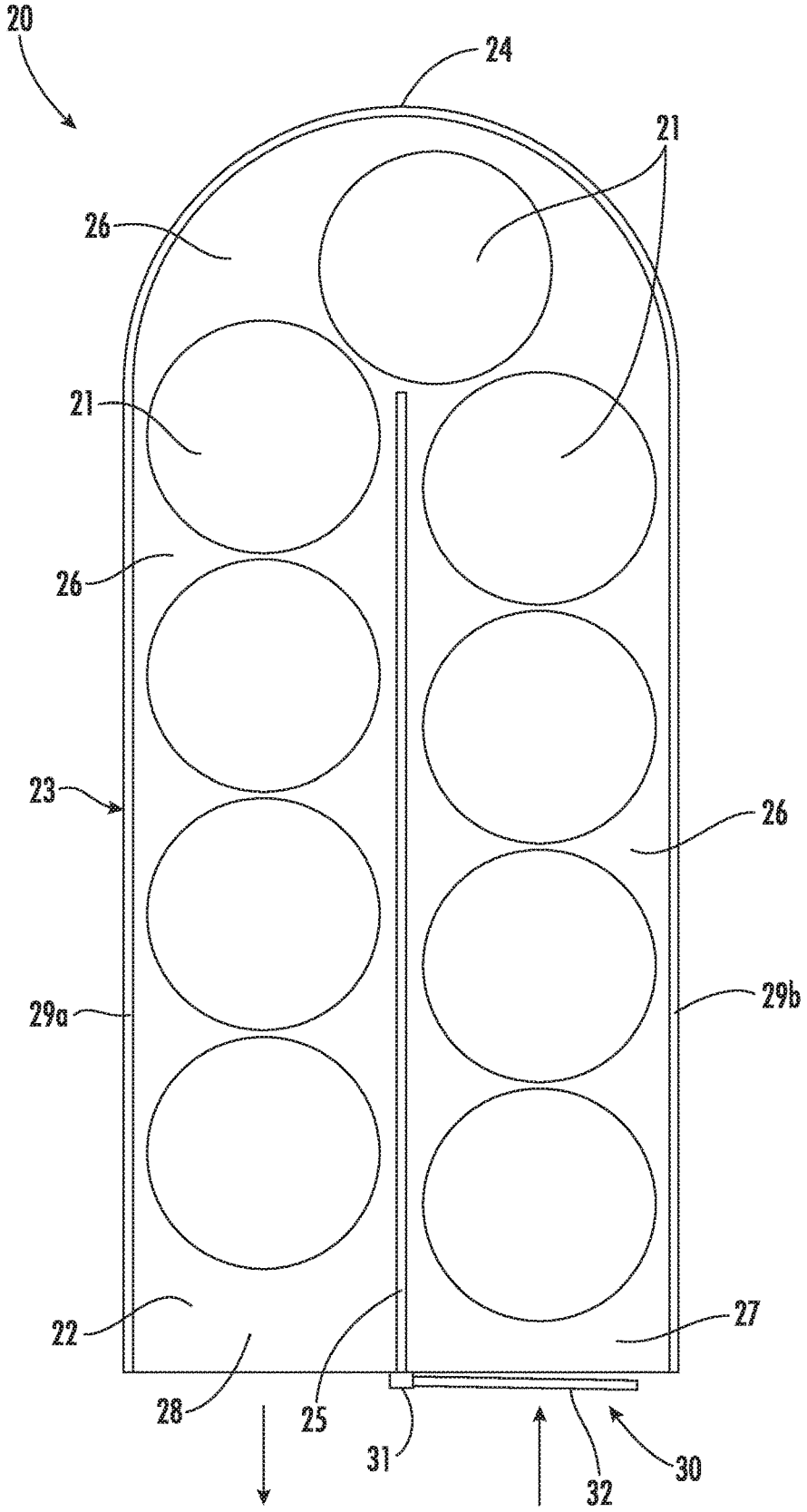
FIG. 1 is a top schematic view of a beverage container serving apparatus in accordance with an embodiment.
Figure 2:
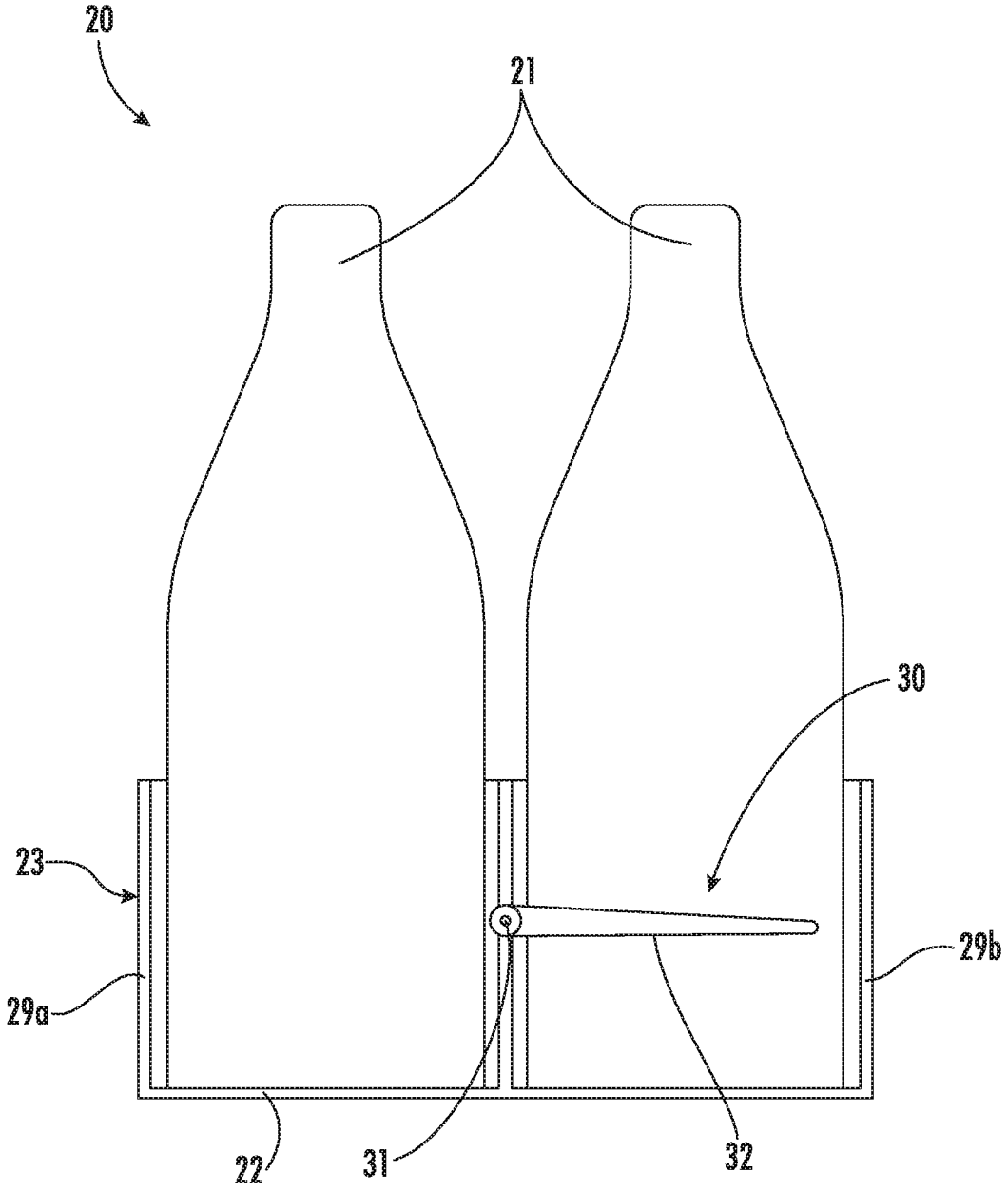
FIG. 2 is a side schematic view of the beverage container serving apparatus of FIG. 1.

Referring initially to FIGS. 1-2, a beverage container serving apparatus 20 for a plurality of beverage containers 21 includes a floor 22 and a sidewall 23 extending upwardly from the floor. The sidewall 23 may be a curved sidewall, for example, having a U-shape. More particularly, the sidewall 23 may include a curved base segment 24 or bend and a pair of parallel arms 29*a*, 29*b* extending from the curved base segment to define the U-shape. In other embodiments, the sidewall 23 may not include a curved base segment 24, but instead, one or more straight base segments, for example.

The beverage container serving apparatus 20 also includes an inner wall 25 extending upwardly from the floor 22 between the pair of parallel arms 29*a*, 29*b* defining a container channel 26. The inner wall 25 may itself have a U-shape or curve, and/or have a width or thickness associated therewith, for example, to carry metering and/or beverage container management devices, as will be explained in further details below. The container channel 26 has a container inlet 27 into which the beverage containers 21 are input and a container outlet 28 from which the beverage containers are served. The container channel 26 is advantageously sized in width to accommodate a single container, for example, bottle or can. The floor 22, sidewall 23 and inner wall 25 may each be plastic, for example. Of course, the floor 22, sidewall 23, and inner wall 25 may be or include other and/or additional types of materials, for example, metal.

During operation, beverage containers 21 are loaded or slid into the container inlet 27. As the beverage containers 21 are loaded, earlier loaded beverage containers will move through the container channel 26 so that the earliest loaded beverage container will be at the container outlet 28. Accordingly, the beverage container serving apparatus 20 may operate using the first-in-first-out (FIFO) principle. Beverage containers are thus served from the container outlet 28 and it is the oldest beverage container 21 or earliest loaded beverage container that is served first. It should be understood that the container inlet 27 and container outlet 28 may be swapped while maintaining FIFO. The rounded sidewall 23, and, more particularly, the curved base segment 24, permits the beverage containers 21 to more easily move from the container inlet 27 to the container outlet 28 upon loading, for example.

To further assist in serving the oldest or earliest loaded beverage container 21 and maintaining a given beverage container from within the container channel 26, the beverage container serving apparatus 20 also includes a movable gate 30 that is adjacent the container inlet 27 and container outlet 28. More particularly, the movable gate 30 is carried by the inner wall 25 and includes a hinge 31 coupled to the inner wall and a movable arm 32, for example, a rigid movable arm, coupled to the hinge so that the movable arm is movable between the container inlet 27 and the container outlet 28. For example, during loading, the movable gate 30, and more particularly, the movable arm 32 is positioned to block the container outlet 28 permitting beverage containers 21 to be loaded into the container inlet 27. Upon completion of loading and during operation, the movable gate 30 or movable arm 32 is moved so that it blocks the container inlet 27. This advantageously provides a visual indicator of which side beverage containers 21 are to be served. In some embodiments, the movable arm 32 may be flexible, for example, flexible plastic, so that the movable arm maintains the beverage containers 21 within either of the container inlet 27 or container outlet 28, but permits, with sufficient force, a beverage container to be pulled or pushed through the movable gate 30. In some embodiments, there may be more than one movable gate 30, for example, mounted to each parallel arm 29*a*, 29*b*.

Figure 3:
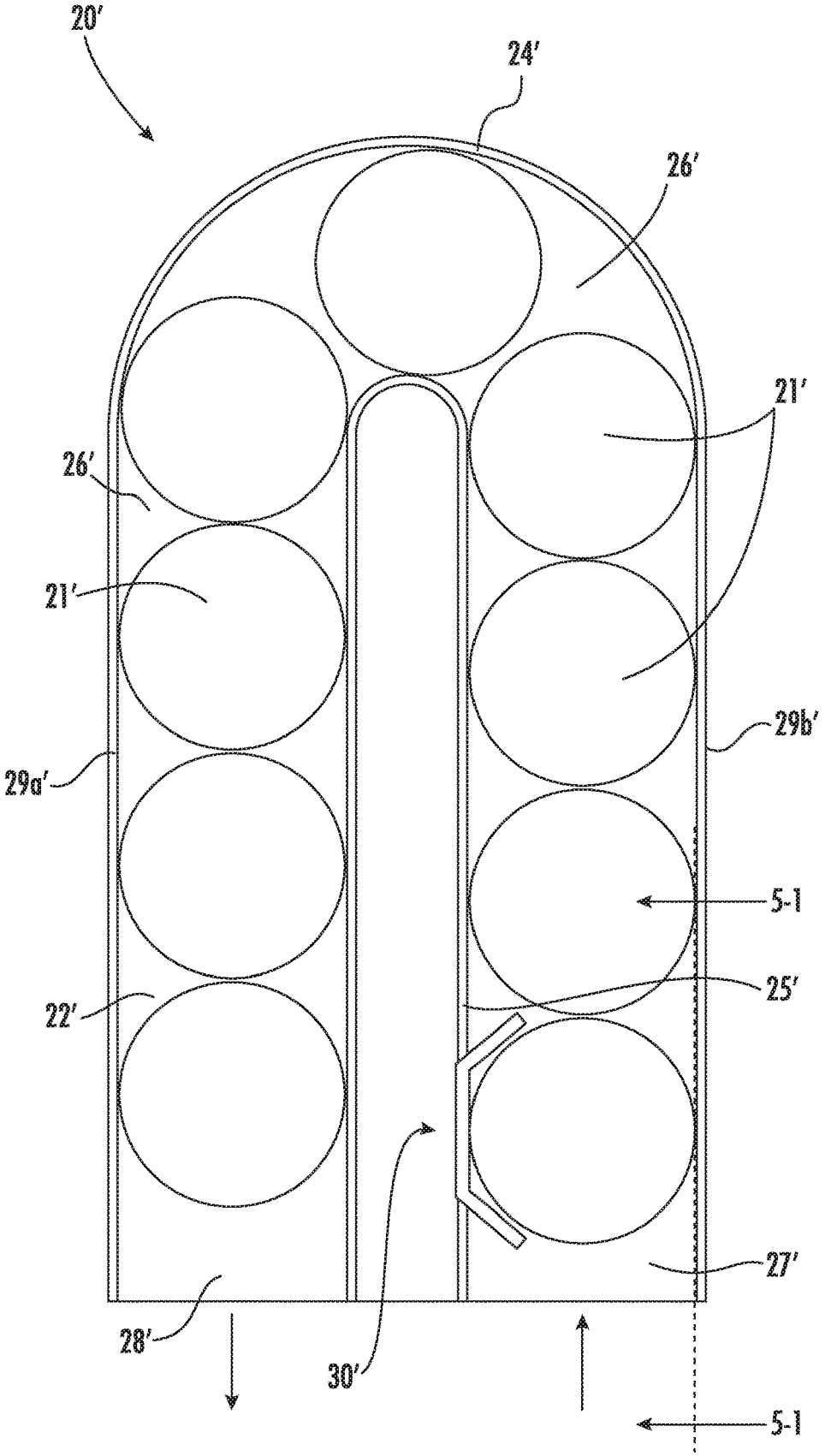
FIG. 3 is a top schematic view of a beverage container serving apparatus in accordance with another embodiment.
Figure 4:
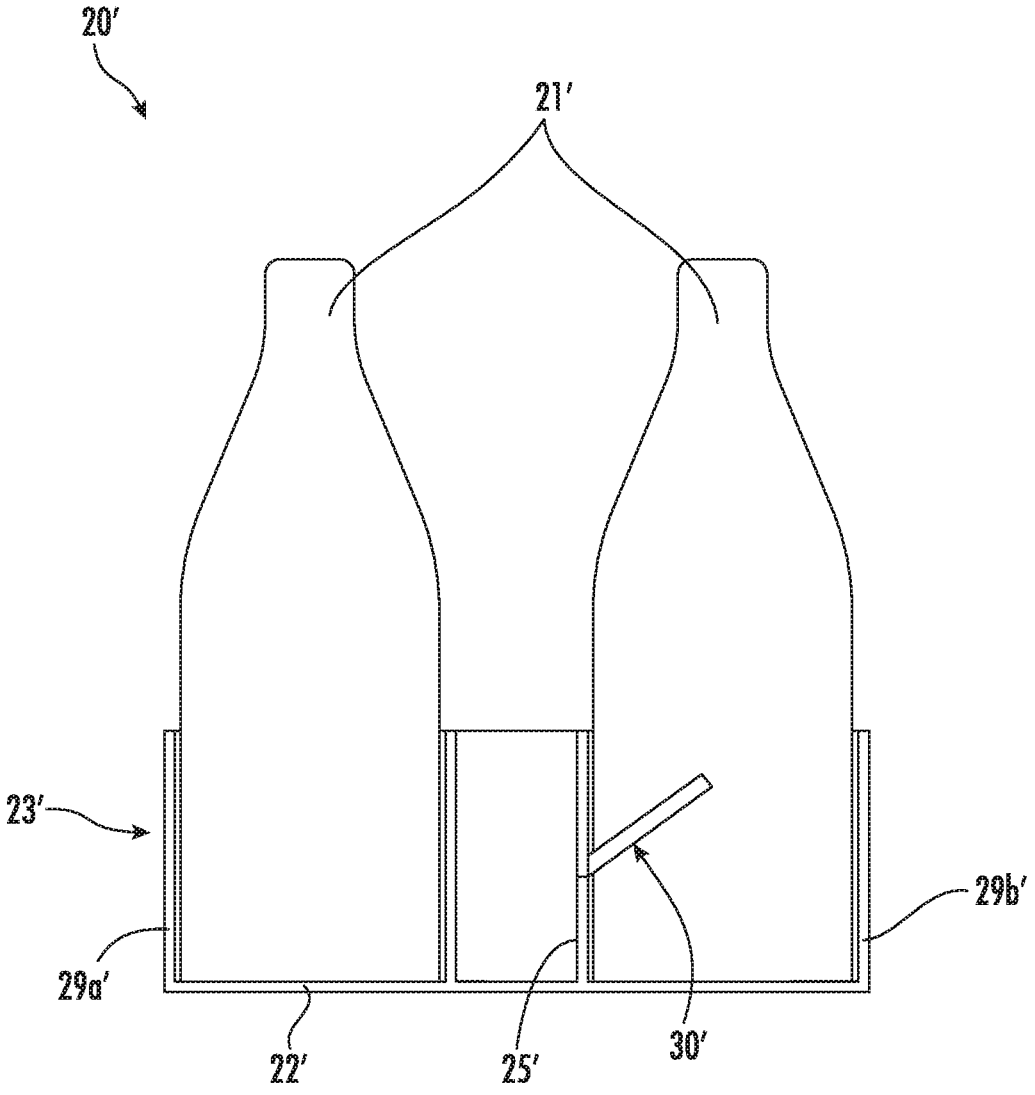
FIG. 4 is a side schematic view of the beverage container serving apparatus of FIG. 3.
Figure 5:
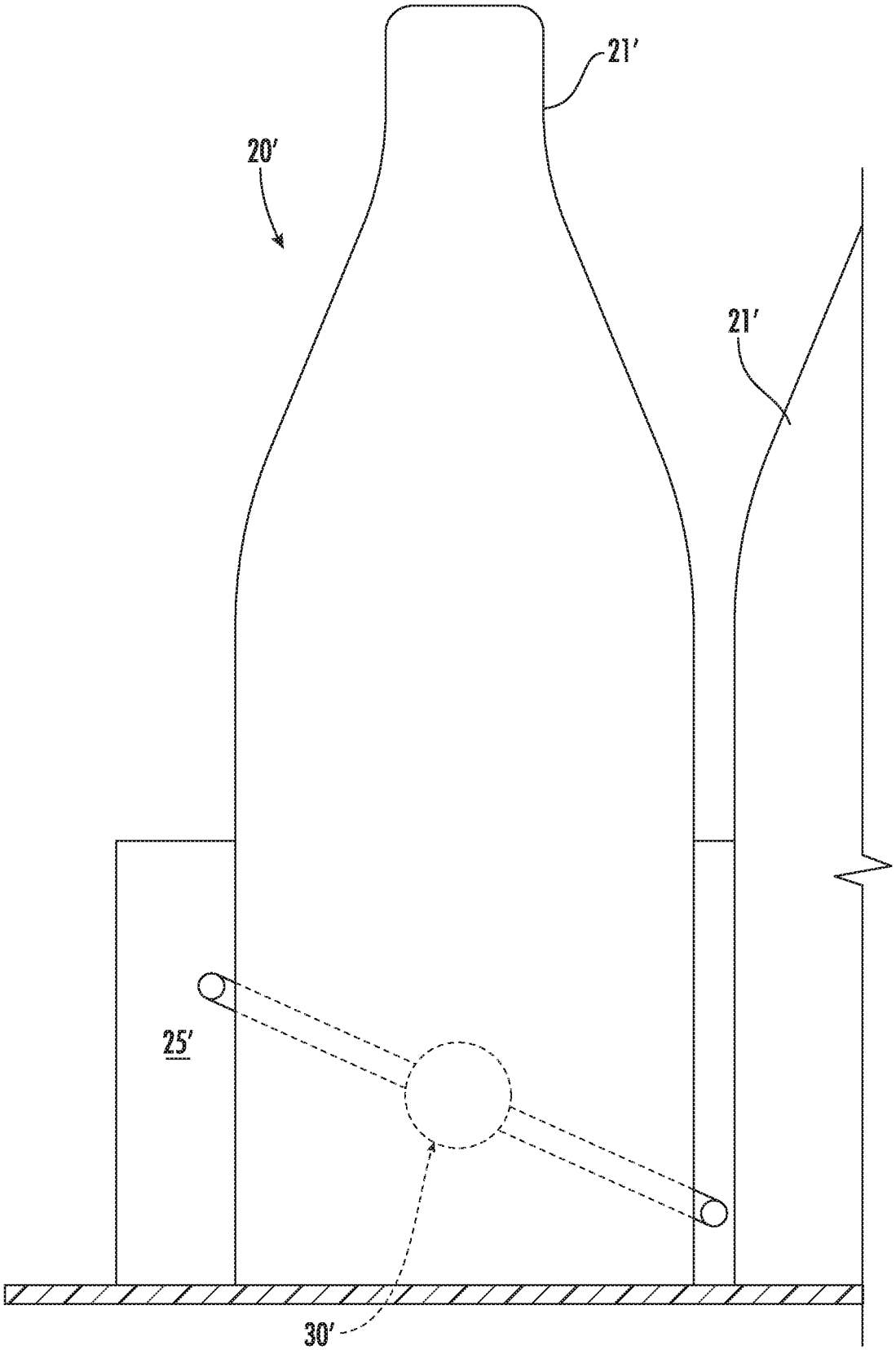
FIG. 5 is an enlarged schematic cross-sectional view of a portion of the beverage container serving apparatus taken along line 5-1 of FIG. 3.

Referring now to FIGS. 3-5, in another embodiment, the movable gate 30' may include or be in the form of a ratcheting turnstile. For example, the ratcheting turnstile 30' may be coupled or mounted to the inner wall 25' within the container inlet 27'. The ratcheting turnstile 30' may be sized so that desired size beverage containers 21' may be placed one at a time through the container inlet 27'. As will be appreciated by those skilled in the art, the ratcheting turnstile 30' may be configured to permit movement of beverage containers 21' in one direction—from the container inlet 27' to the container outlet 28'. However, in some embodiments, the ratcheting turnstile 30' may be configured to provide movement of beverage containers 21' in the opposite direction—that is from the container outlet 28' to the container inlet 27'.

While the ratcheting turnstile 30' is illustratively carried by the inner wall 25', those skilled in the art will appreciate that the ratcheting turnstile may be carried by either of the parallel arms 29*a*', 29*b*' or within the floor 22' (e.g., extending upwardly therefrom). In some embodiments, a further ratcheting turnstile may be coupled adjacent or within the container outlet 28', for example, to meter serving and provide a container output count (i.e., a counter). Other and/or additional counting mechanisms or devices may be used, for example, independently from any ratcheting turnstile. Of course, any counter may be used in any of the embodiments described herein.

Figure 6:
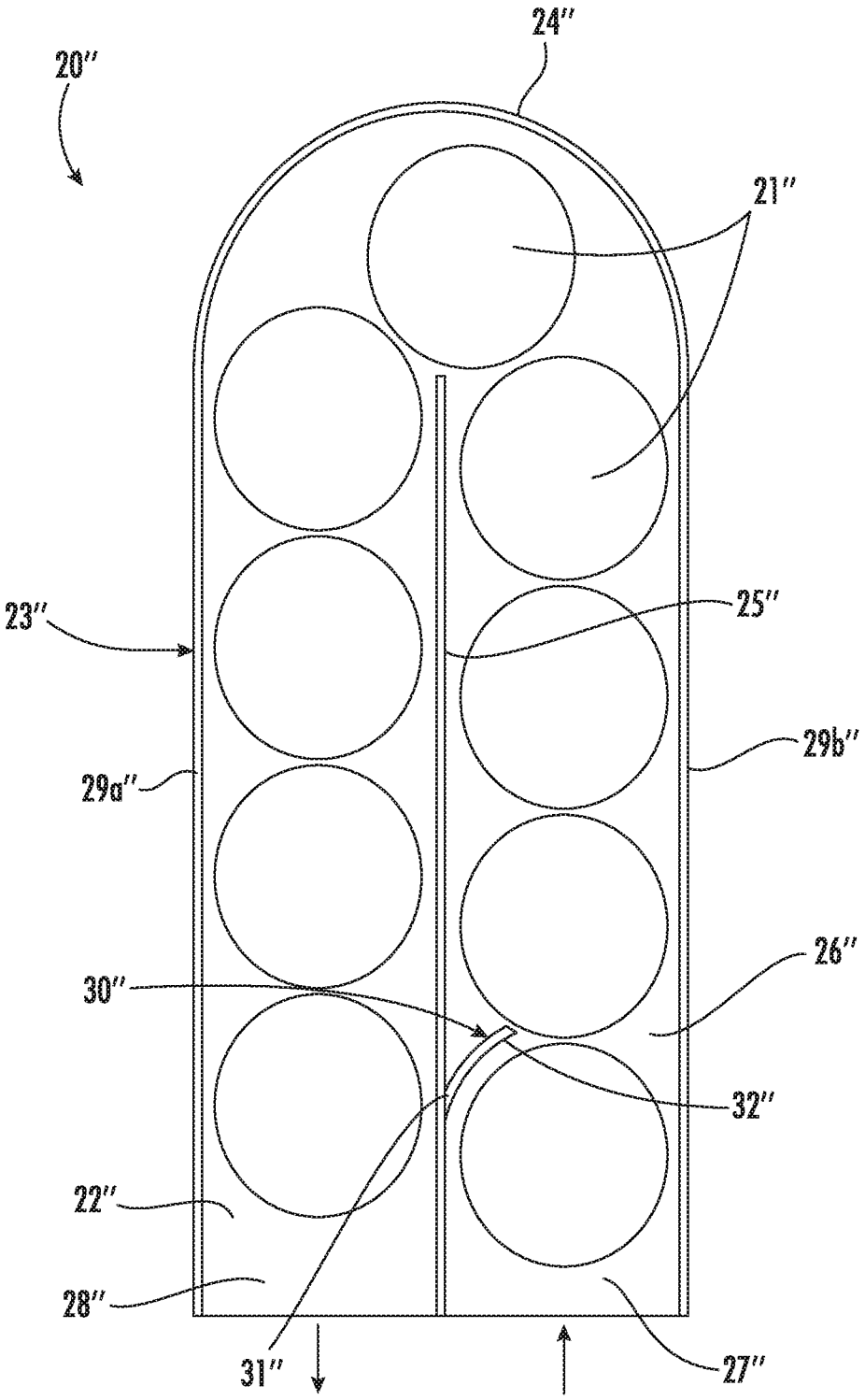
FIG. 6 is a top schematic view of a beverage container serving apparatus in accordance with another embodiment.
Figure 7:
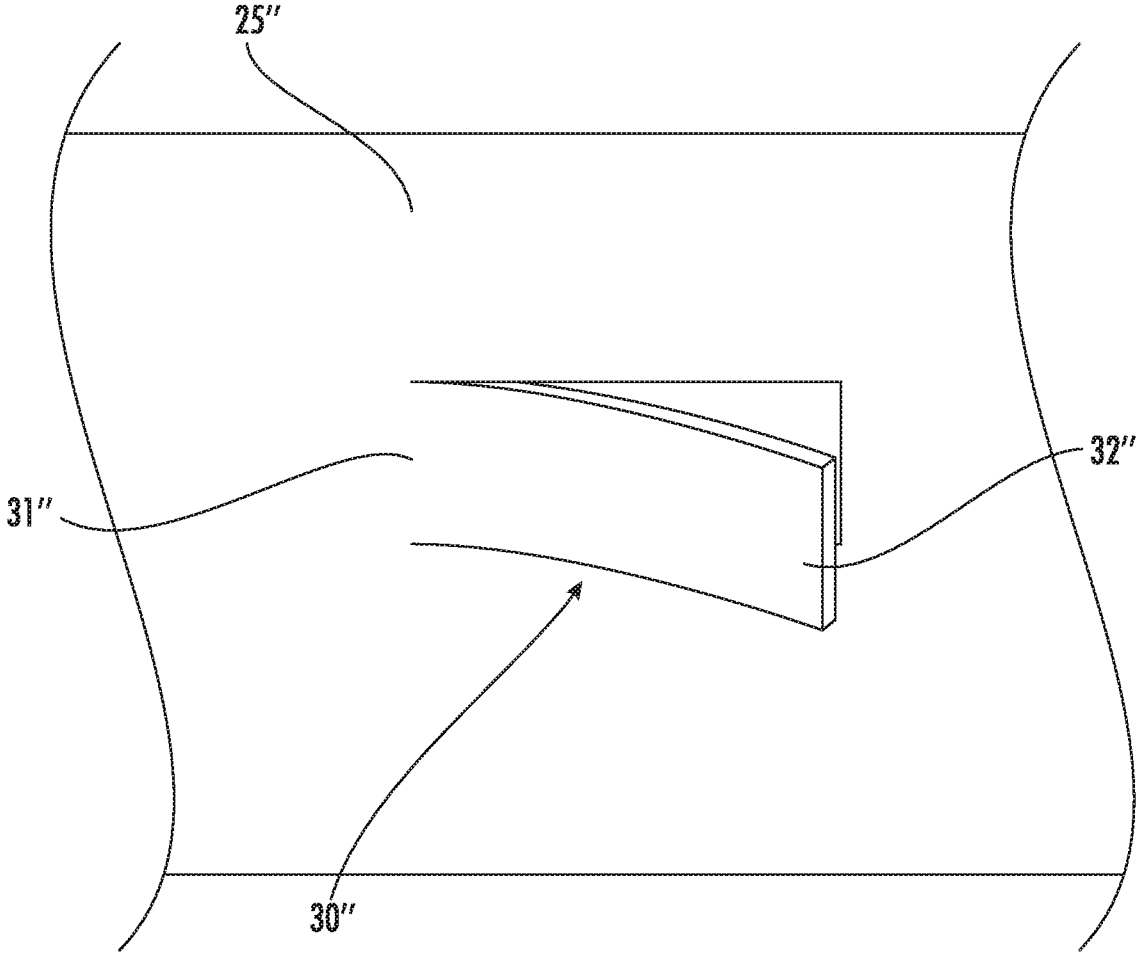
FIG. 7 is an enlarged schematic cross-sectional view of a portion of the beverage container serving apparatus of FIG. 6.

Referring now to FIGS. 6-7, in another embodiment, the movable gate 30" may include or be in the form of a curved gate integrally molded (e.g., a monolithic unit) with the inner wall 25" and extending within the container channel 26". The curved gate 30" may include a hinge 31", for example, a living hinge, and a movable arm 32" and may have a contour that matches the beverage containers 21". The curved gate 30" may be stamped from the inner wall 25". In other embodiments, the curved gate 30" may be integrally molded with the sidewall 23", for example, one or more of the parallel arms 29*a*", 29*b*".

Figure 8:
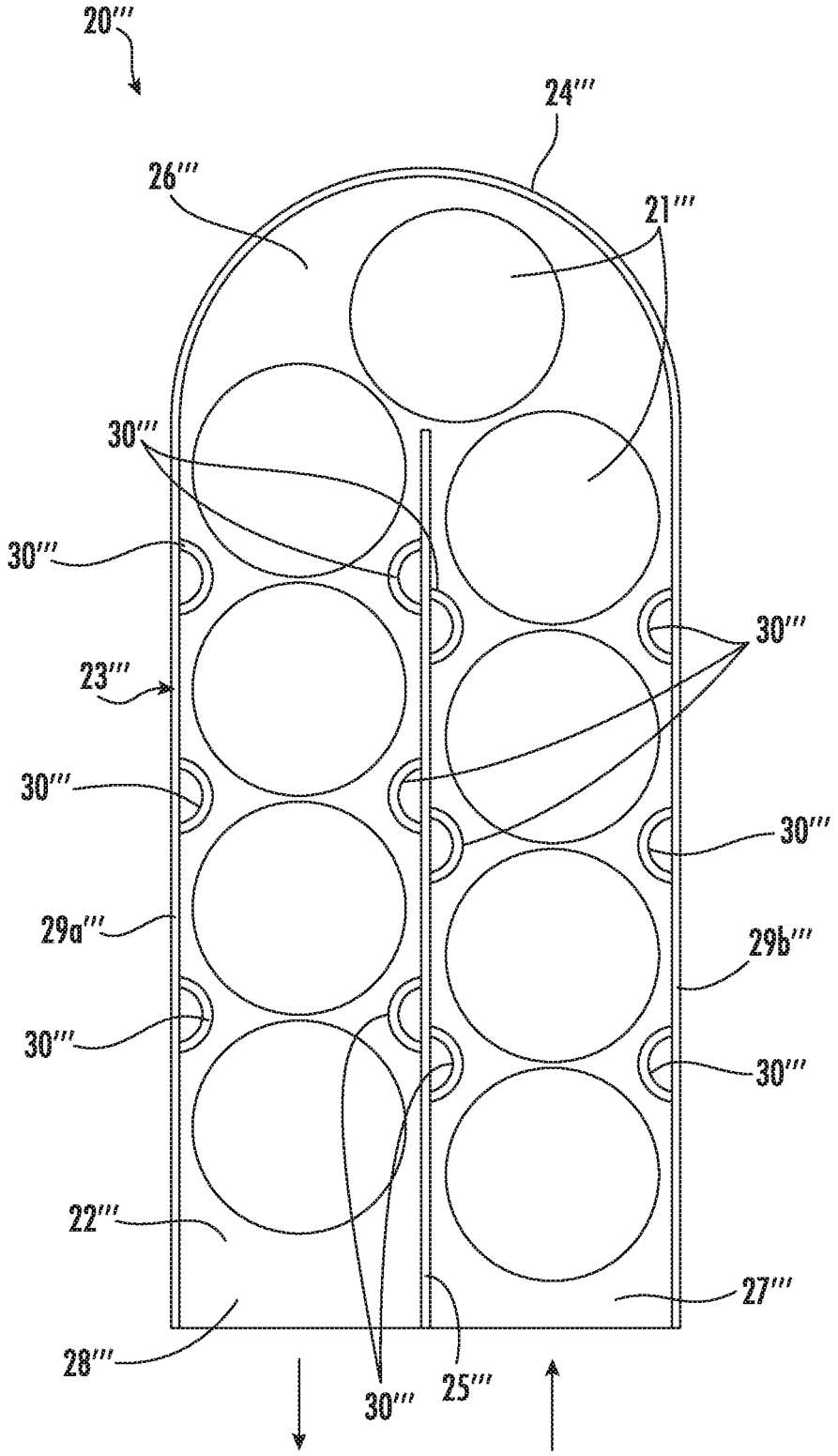
FIG. 8 is a top schematic view of a beverage container serving apparatus in accordance with another embodiment.
Figure 9:
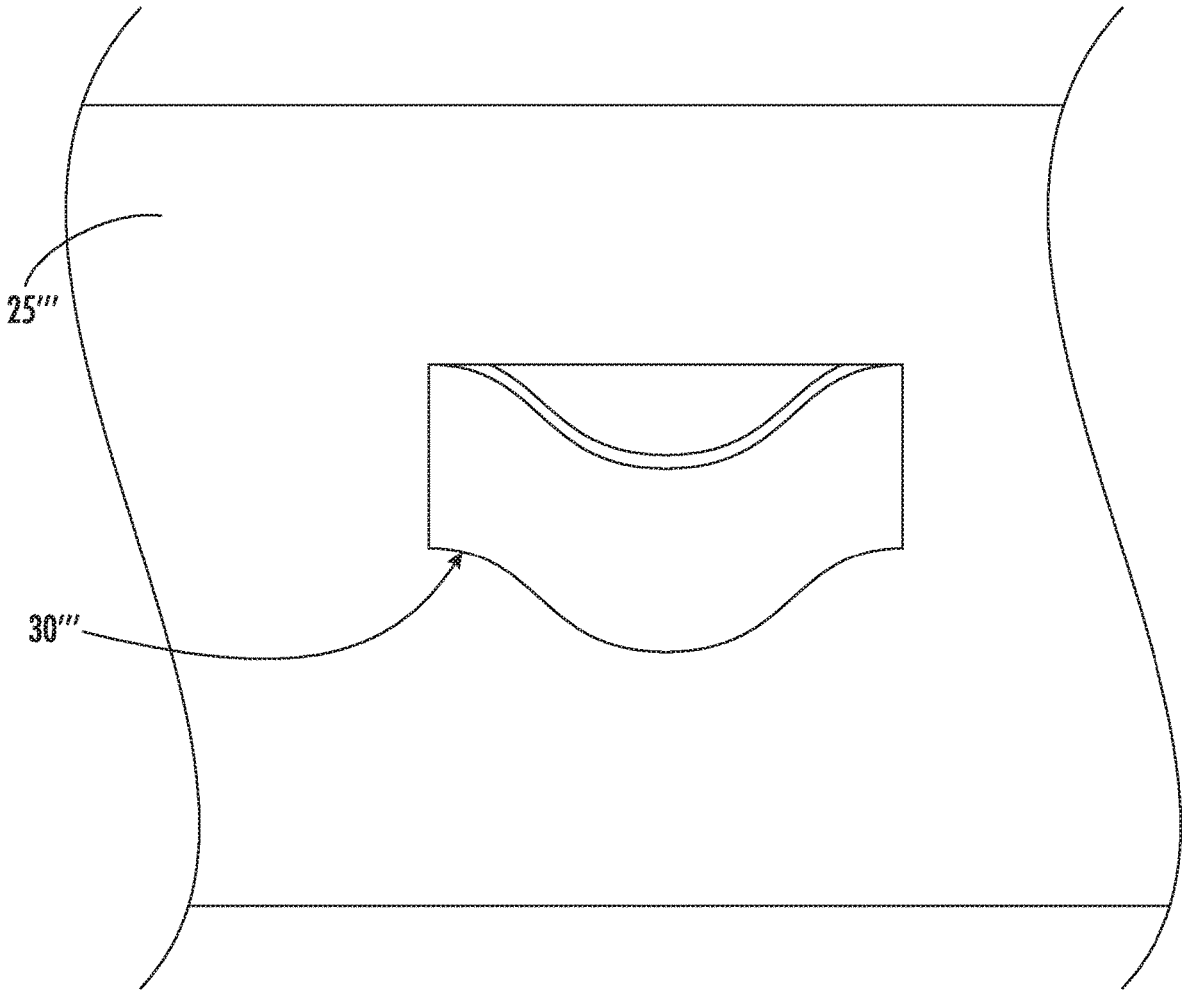
FIG. 9 is an enlarged schematic cross-sectional view of a portion of the beverage container serving apparatus of FIG. 8.

Referring now to FIGS. 8-9, the movable gate 30''' may include or be in the form of spaced apart resilient protrusions extending into the container channel 26''', for example, carried by the inner wall 25'''. The resilient protrusions 30''' may be stamped from the inner wall 25''' and each have a curved, or more particularly, a semi-circular shape. The resilient protrusions 30''' may also be carried by the sidewall 23''' and be aligned (e.g., across from) with the resilient protrusions carried by the inner wall 25'''. The resilient protrusions 30''' carried by the sidewall 23''' may be formed similarly to the resilient protrusions carried by the inner wall 25'''. The spacing between adjacent resilient protrusions 30''' may be determined based upon the sizing of the beverage containers 21'''. During operation, each beverage container 21''' rests between the adjacent resilient protrusions 30''' in the container channel 26'''. When adding a beverage container 21''' to the container channel 26''' pressure is applied to resilient protrusions 30''' by a moving beverage container causing the resilient protrusions to bend inwardly toward the inner wall 25''' and the sidewall 23'''. Upon passage of the container 21''' to the space between the next or adjacent resilient protrusion 30''', the resilient protrusions previously under pressure return to their original curved shape. Indeed, the resilient protrusions 30''' function to maintain the beverage containers 21''' within the container channel 26'''. As will be appreciated by those skilled in the art, there may be any number of resilient protrusions 30''', which may be positioned anywhere along the container channel 26'''. The resilient protrusions 30''' may be oriented differently than illustrated, for example, and may have a different shape, such as, triangular, semi-tubular, cylindrical, etc.

Figure 10:
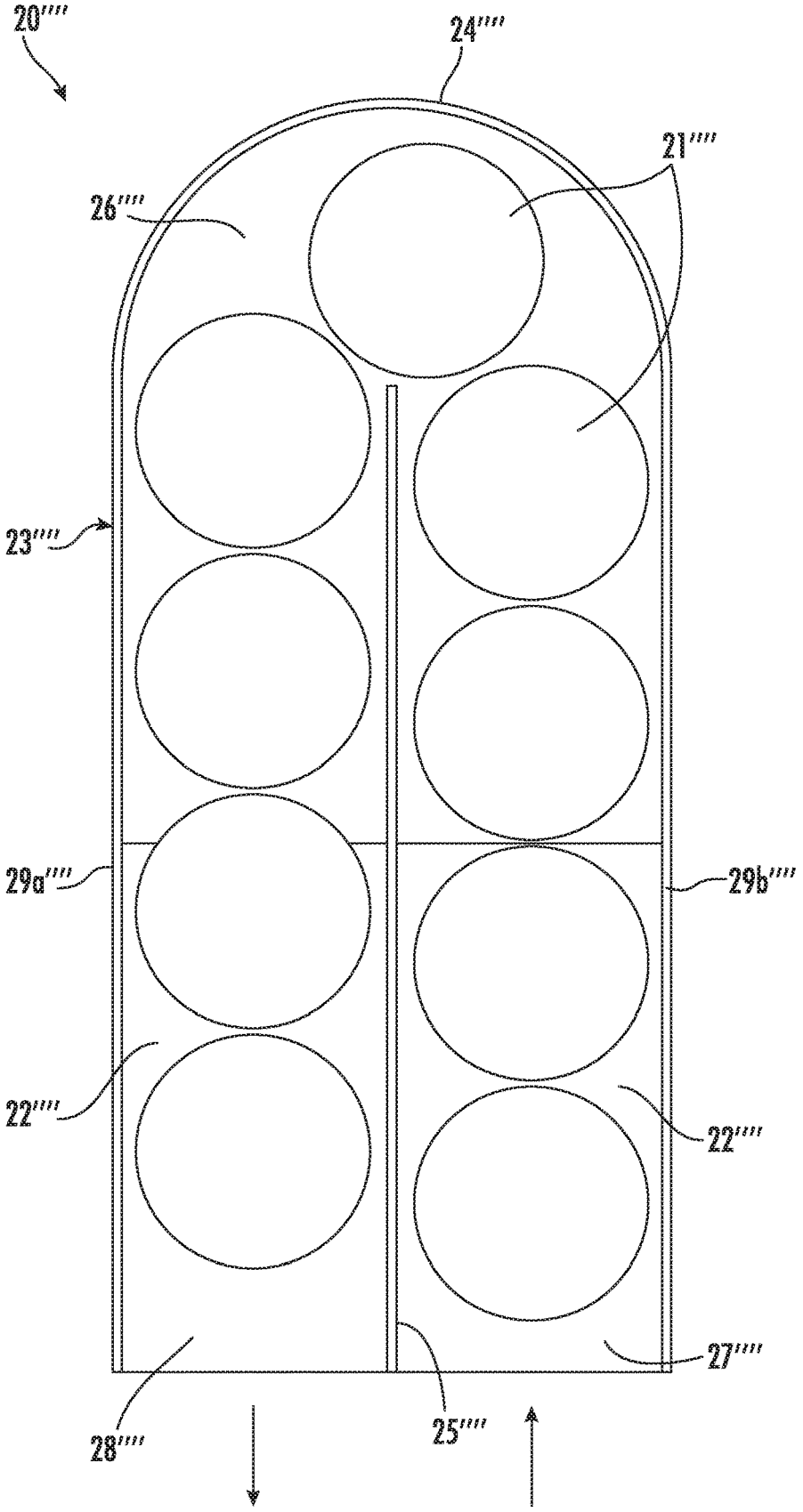
FIG. 10 is a top schematic view of a beverage container serving apparatus in accordance with another embodiment.
Figure 11:
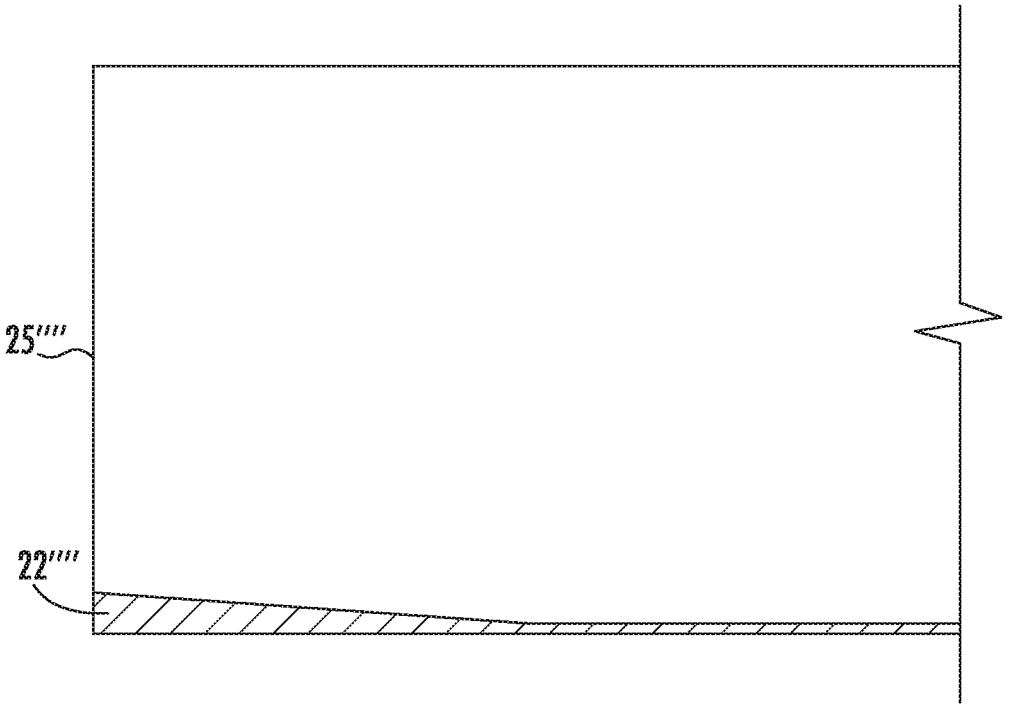
FIG. 11 is an enlarged schematic cross-sectional view of a portion of the beverage container serving apparatus of FIG. 10.
Figure 12:
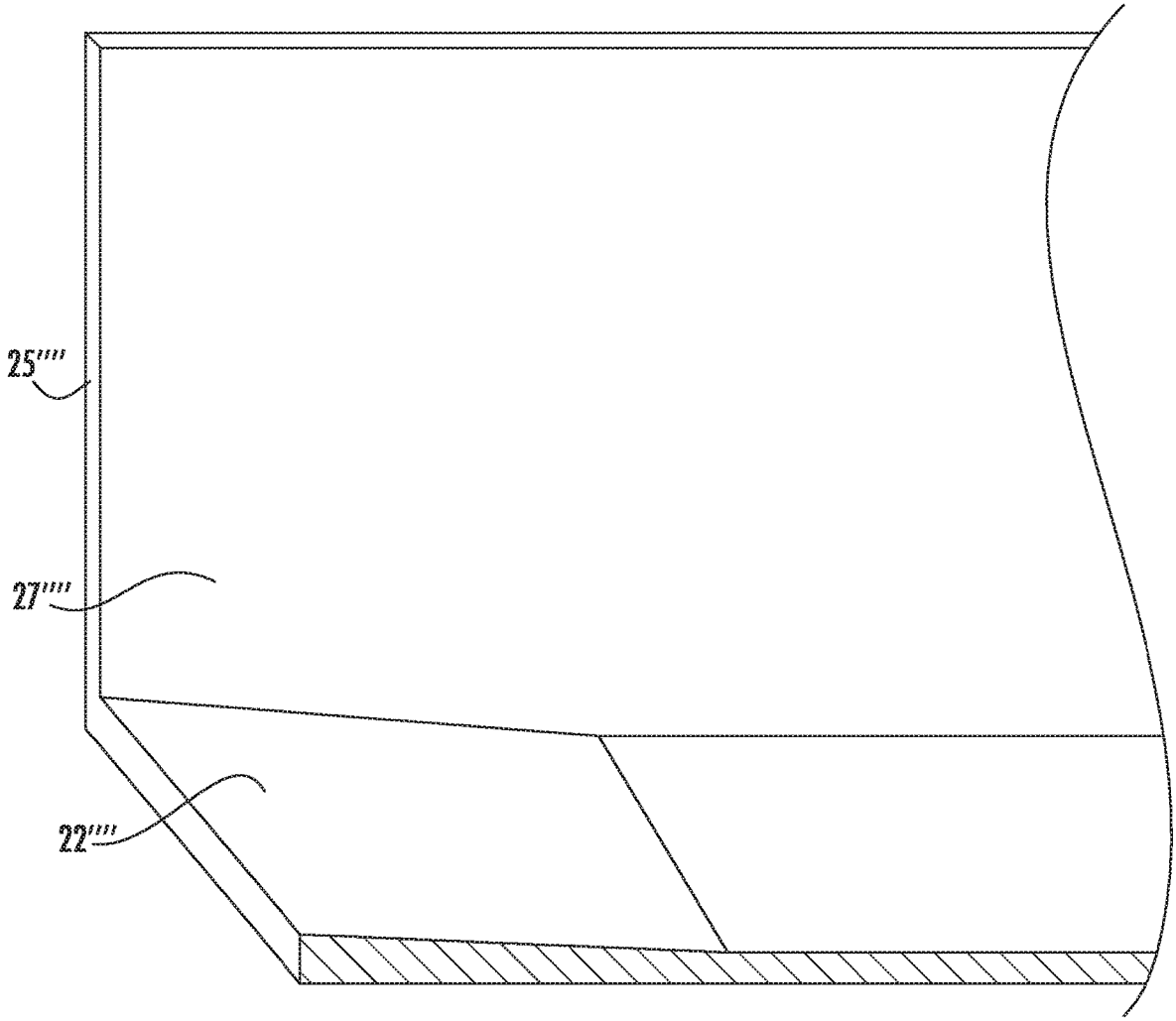
FIG. 12 is an enlarged perspective schematic cross-sectional view of a portion of the beverage container serving apparatus of FIG. 10.

Referring now to FIGS. 10-12, the beverage container serving apparatus 20'''' has a sloped floor 22''''. The sloped floor 22'''' is illustratively sloped downwardly relative to the container inlet 27'''' and container outlet 28''''. In other words, a portion of the floor 22'''' adjacent the container inlet 27'''' and the container outlet 28'''' are each sloped downwardly toward the bend 24''''. While a portion of the floor 22'''' is illustratively sloped downwardly, it should be appreciated that any portion of the floor or segment thereof may be sloped, and/or one of the container inlet 27'''' and container outlet 28'''' may be sloped. The sloped floor 22'''' advantageously facilitates loading of beverage containers 21'''' through the container inlet 27'''' and helps maintain the beverage containers from spilling out of the container outlet 28''''.

Figure 13:
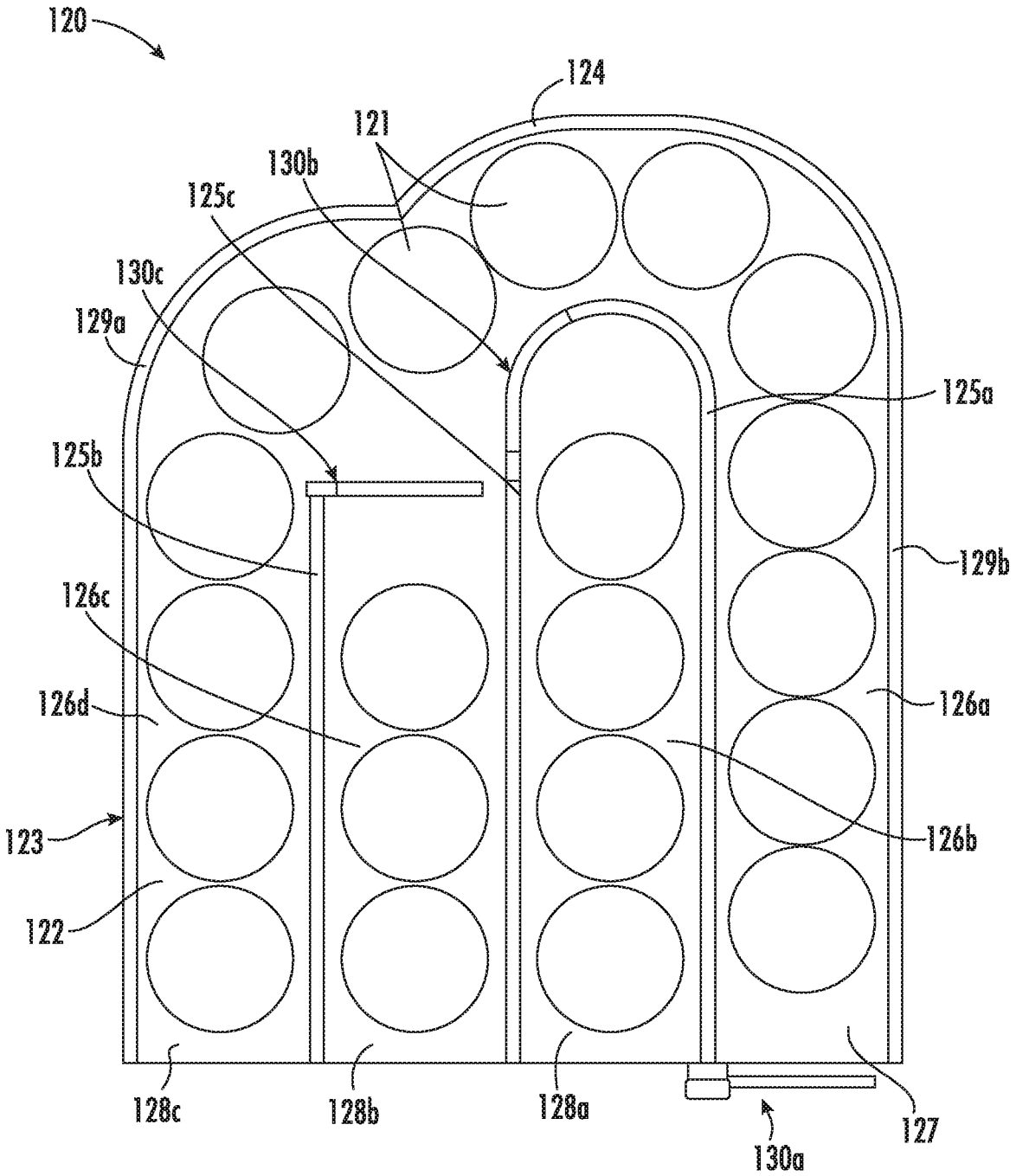
FIG. 13 is a top schematic view of a beverage container serving apparatus in accordance with another embodiment.

Referring now to FIG. 13, in another embodiment, the beverage container serving apparatus 120 may include multiple inner walls **125*a*-125*c* that may each extend upwardly from the floor 122 to define multiple container channels 126*a*-126*d*. For example, the container channel 126*a* may include the container inlet 127, while the container channels 126*b*-126*d* may have a common container inlet with the container channel 126*a* and respective container outlets 128*a*-128*c*. As will be appreciated by those skilled in the art, any of the container channels 126*a*-126*d* may be configured as a container inlet or container outlet. Movable gates 130*a*-130*c* may be carried by or coupled to respective inner walls 125*a*-125*c* to control movement of the beverage containers 121 to desired beverage container channels 126*a*-126*d*. There may be any number of movable gates 130*a*-130*c*, and any of the movable gates may be positioned to be carried anywhere by any of the sidewall 123 and inner walls 125*a*-125*c*. The movable gates 130*a*-130*c*** may also be configured to pivot in different directions so as to reduce interference with beverage container movement.

Figure 14:
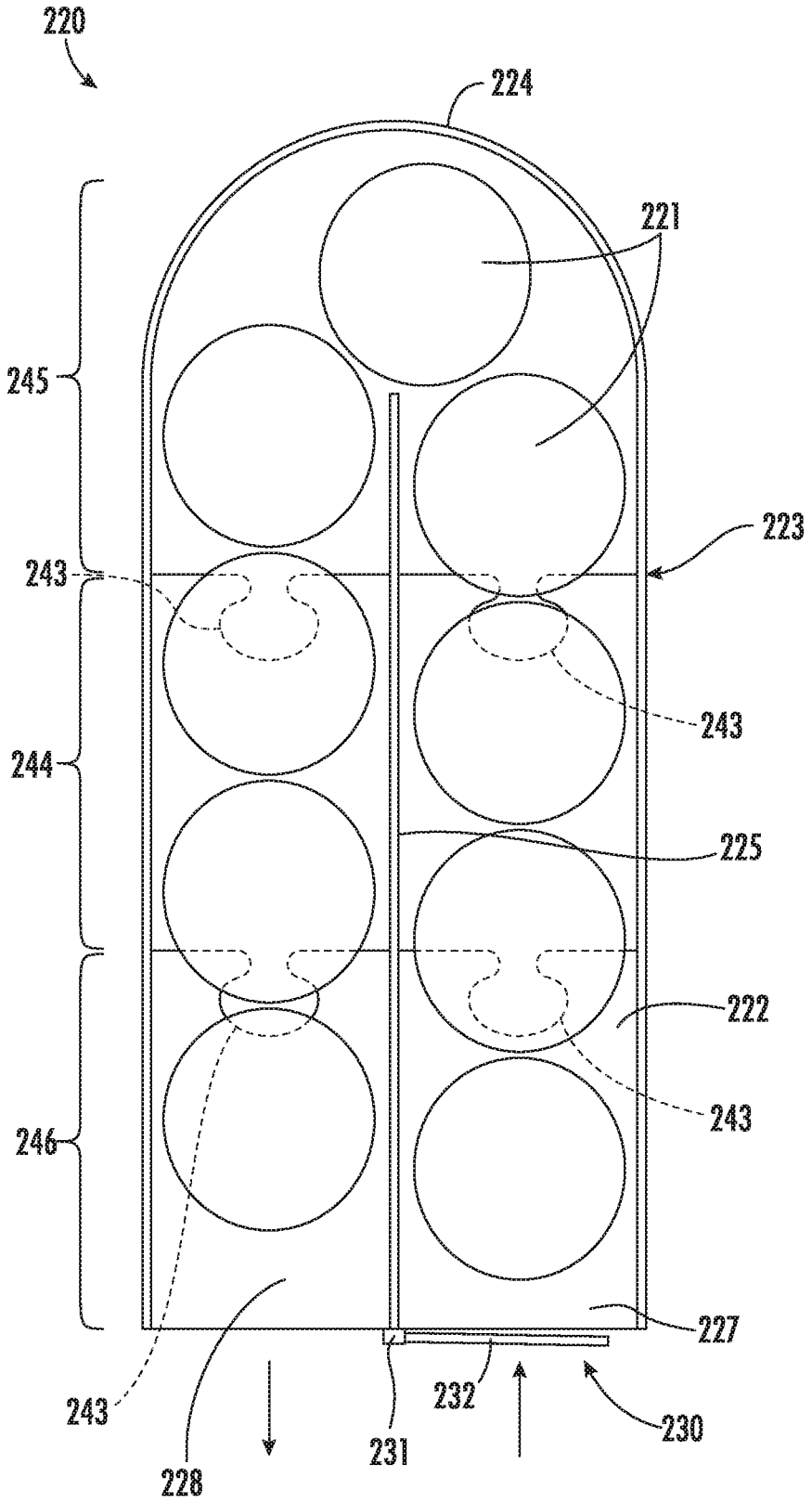
FIG. 14 is a top schematic view of a beverage container serving apparatus in accordance with another embodiment.

Referring now to FIG. 14, in another embodiment, the beverage container serving apparatus 220 may be adjustable in size, for example, to accommodate different depth refrigeration units in which the beverage container serving apparatus may be placed. In particular, the floor 222, the sidewall 223, and the inner wall 225 may be segmented and each segment includes interconnecting bodies, for example, a tab 243 and/or a corresponding blank or recess. Segments 244, 245, 246 may be added and removed between end segments (e.g., the portion of the sidewall with the U-shape and the container inlet and outlet 227, 228 along with the movable gate 232. In other embodiments, the sidewall 223 and the inner wall 225 may be slidably adjusted in terms of length (to accommodate different depth refrigeration units) and coupled by a fastener, for example, snapped, into segments of the floor. Floor segments 244, 245, 246 may be laterally (e.g., side-by-side) joined by one or more fasteners along with additional inner walls to form multiple container channels.

A method aspect is directed to a method of making a beverage container serving apparatus 20 for beverage containers 21. The method includes forming a floor 22 and forming a sidewall 23 extending upwardly from the floor and that includes a curved base segment 24 and a pair of parallel arms **29*a*, 29*b* extending from the curved base segment. The method also includes forming an inner wall 25 extending upwardly from the floor 22 between the pair of parallel arms 29*a*, 29*b* defining a container channel 26 having a container inlet 27 into which the beverage containers 21 are input and a container outlet 28 from which the beverage containers are served. The method further includes forming a movable gate 30 adjacent one of the container inlet 27 and container outlet 28 and that maintains a given beverage container 21 within the container channel 26**.

While beverage containers are described herein, it will be appreciated by those skilled in the art that the beverage container serving apparatus can be applied to all types and shapes of containers. For example, the apparatus described herein may be applicable to containers of solids, particularly where it may be desirable to implement a first-in, first-out system.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A beverage container serving apparatus for a plurality of beverage containers, the beverage serving apparatus comprising:

a floor;

at least one sidewall extending upwardly from the floor and comprising a curved base segment and a pair of parallel arms extending from the curved base segment;

an inner wall extending upwardly from the floor between the pair of parallel arms defining a container channel having a container inlet into which the plurality of beverage containers is input and a container outlet from which the plurality of beverage containers is served; and a movable gate adjacent one of the container inlet and container outlet and configured to maintain a given beverage container from among the plurality thereof within the container channel.

2. The beverage container serving apparatus of claim 1 wherein the at least one sidewall has a U-shape.

3. The beverage container serving apparatus of claim 1 wherein the movable gate comprises a hinge coupled to the inner wall and a movable arm coupled to the hinge so that the arm is movable between the container inlet and the container outlet.

4. The beverage container serving apparatus of claim 1 wherein the movable gate comprises a ratcheting turnstile.

5. The beverage container serving apparatus of claim 1 wherein the movable gate comprises a curved gate integrally molded with at least one of the inner wall and the at least one sidewall.

6. The beverage container serving apparatus of claim 1 wherein the floor is sloped downwardly relative to the container inlet and container outlet.

7. The beverage container serving apparatus of claim 1 wherein the movable gate comprises at least one resilient protrusion extending into the container channel.

8. The beverage container serving apparatus of claim 7 wherein the at least one resilient protrusion has a curved shape.

9. The beverage container serving apparatus of claim 7 wherein the at least one resilient protrusion comprises a plurality of spaced apart resilient protrusions extending along the at least one sidewall and the inner wall.

10. The beverage container serving apparatus of claim 1 further comprising at least one further inner wall extending upwardly from the floor to define a plurality of container channels.

11. The beverage container serving apparatus of claim 10 further comprising at least one further movable gate adjacent the curved base segment to selectively block at least one corresponding container channel from the plurality thereof.

12. A beverage container serving apparatus for a plurality of beverage containers, the beverage serving apparatus comprising:

a floor;

at least one U-shaped sidewall extending upwardly from the floor and comprising a curved base segment and a pair of parallel arms extending from the curved base segment;

an inner wall extending upwardly from the floor between the pair of parallel arms defining a container channel having a container inlet into which the plurality of beverage containers is input and a container outlet from which the plurality of beverage containers is served; and at least one resilient protrusion adjacent one of the container inlet and container outlet and configured to maintain a given beverage container from among the plurality thereof within the container channel.

13. The beverage container serving apparatus of claim 12 wherein the at least one resilient protrusion has a curved shape.

14. The beverage container serving apparatus of claim 12 wherein the at least one resilient protrusion comprises a plurality of spaced apart resilient protrusions extending along the at least one sidewall and the inner wall.

15. The beverage container serving apparatus of claim 12 wherein the floor is sloped downwardly relative to the container inlet and container outlet.

16. The beverage container serving apparatus of claim 12 further comprising at least one further inner wall extending upwardly from the floor to define a plurality of container channels.

17. A method of making a beverage container serving apparatus for a plurality of beverage containers, the method comprising:

forming a floor;

forming at least one sidewall extending upwardly from the floor and comprising a curved base segment and a pair of parallel arms extending from the curved base segment;

forming an inner wall extending upwardly from the floor between the pair of parallel arms defining a container channel having a container inlet into which the plurality of beverage containers is input and a container outlet from which the plurality of beverage containers is served; and forming a movable gate adjacent one of the container inlet and container outlet and configured to maintain a given beverage container from among the plurality thereof within the container channel.

18. The method of claim 17 wherein forming the at least one sidewall comprises forming the at least one sidewall to have a U-shape.

19. The method of claim 17 wherein forming the movable gate comprises forming a movable gate comprising a hinge coupled to the inner wall and a movable arm coupled to the hinge so that the arm is movable between the container inlet and the container outlet.

20. The method of claim 17 wherein forming the movable gate comprises forming a ratcheting turnstile.

21. The method of claim 17 wherein forming the movable gate comprises forming a curved gate integrally molded with at least one of the inner wall and at least one sidewall.

22. The method of claim 17 wherein forming the movable gate comprises forming at least one resilient protrusion extending into the container channel.

* * * * *